US007932194B2

(12) United States Patent
Bader et al.

(10) Patent No.: US 7,932,194 B2
(45) Date of Patent: Apr. 26, 2011

(54) FABRIC FOR PROTECTIVE GARMENTS

(75) Inventors: Yves Bader, Thoiry (FR); Andre Capt, Gland (CH); Thomas Dotsch, Selb (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 169 days.

(21) Appl. No.: 10/524,310

(22) PCT Filed: Sep. 3, 2003

(86) PCT No.: PCT/IB03/03701

§ 371 (c)(1),
(2), (4) Date: Aug. 24, 2005

(87) PCT Pub. No.: WO2004/023909

PCT Pub. Date: Mar. 25, 2004

(65) Prior Publication Data

US 2006/0035553 A1 Feb. 16, 2006

(30) Foreign Application Priority Data

Sep. 12, 2002 (DE) ..... 202 14 118 U

(51) Int. Cl.
*D03D 11/00* (2006.01)
*D03D 15/00* (2006.01)

(52) U.S. Cl. ..... 442/217; 442/203; 442/220; 442/303; 139/408; 139/413; 139/420 R

(58) Field of Classification Search ..... 428/72, 428/172, 167; 442/203, 205–207, 239, 217, 442/220, 303; 139/408, 413, 420 R
See application file for complete search history.

(56) References Cited

U.S. PATENT DOCUMENTS 2,884,018 A 4/1959 Delcellier et al.
3,061,839 A * 11/1962 Foster ..... 2/2.5
3,359,610 A * 12/1967 Faircloth ..... 28/156
4,814,222 A 3/1989 Davis et al.
4,897,886 A 2/1990 Grilliot et al.
(Continued)

FOREIGN PATENT DOCUMENTS

JP 5-387635 A 11/1933
(Continued)

OTHER PUBLICATIONS

The Metropolitan (Tokyo) Fireboard-Rescue Garment Specification (English Translation).

*Primary Examiner* — Jenna-Leigh Johnson

(57) ABSTRACT

The present invention relates to a heat, flame, and electric arc resistant fabric (1) for use as single or outer layer of protective garments. The fabric (1) of the invention comprises at least two separate single plies which are assembled together at predefined positions so as to build pockets (4). The fabric (1) of the invention is made of materials independently chosen from the group consisting of aramid fibers and filaments, polybenzimidazol fibers and filaments, polyamidimid fibers and filaments, poly(paraphephenylene benzobisaxazole) fibers and filaments, phenol-formaldehyde fibers and filaments, melamine fibers and filaments, natural fibers and filaments, synthetic fibers and filaments, artificial fibers and filaments, glass fibers and filaments, carbon fibers and filaments, metal fibers and filaments, and composites thereof. Due to its peculiar structure, the fabric (1) according to the present invention can have a specific weight which is considerably lower than that of known fabrics having comparable mechanical and thermal properties.

9 Claims, 6 Drawing Sheets

U.S. PATENT DOCUMENTS 5,685,347 A * 11/1997 Graham et al. ..... 139/390
5,701,606 A 12/1997 Aldridge

FOREIGN PATENT DOCUMENTS

JP 38-21670 10/1963
JP 43-34548 B 6/1966
JP 47-33272 A 12/1972
JP SHO 47-35498 12/1972
JP 2000-21281 A 8/2000
WO WO 00/57738 A 10/2000
WO WO/0066823 A 11/2000
WO WO 01/64985 A 9/2001
WO WO 03/039280 5/2003

* cited by examiner

FABRIC FOR PROTECTIVE GARMENTS

BACKGROUND OF THE INVENTION

1. Field of the Invention

The invention relates to a heat, flame and electric arc resistant fabric for use as single or outer layer of protective garments.

2. Description of Related Art

A garment protecting against heat, flame and electric arc is usually very heavy because the mass and the thickness of the garment itself are normally the main factors conferring protection. The wearer of such a garment, like for example the firefighter, is therefore limited in his movements and undergoes heat stress so that the overall wear comfort strongly decreases. In the last twenty years, attempts have continuously been made to develop new materials in order to improve the wear comfort of such protective garments. For example, lighter but more voluminous insulating materials have been developed for this purpose. These materials confer more lightness to the final protective garment but they might affect the respiratory activities of the wearer due to their cumbersome dimensions. Furthermore, the freedom of movement is not necessarily improved by using these materials.

Garments protecting against heat, flame and electric arc are usually made of one or more layers. The choice of the different materials and of the number of layers constituting the final protective garment depends on the specific application of the garment itself.

When designing a new protective garment, care must be taken that all criteria of the relevant national and international norms are fulfilled. As an example, heat and flame resistant garments must be manufactured in accordance with EN-340, EN-531, EN 469 as well as NFPA 1971:2000, NFPA 2112:2001, and NFPA 70E:2000. For instance, a lighter protective garment could be manufactured by simply using lighter materials. However, this is usually associated with a decrease of the mechanical and thermal properties of the protective garment.

U.S. Pat. No. 5,701,606 discloses a firefighter garment having an outer shell and an inner liner functioning as a combined thermal barrier and moisture barrier made of a fire-retardant, closed-cell foam material. The closed-cell foam liner is moisture resistant and provides thermal insulation. The garment disclosed in this prior art document provides good flame resistance but its weight is elevated since it consists of several fabric layers each having a considerable thickness.

U.S. Pat. No. 4,897,886 discloses a firefighters garment having an outer layer, an intermediate layer and an inner layer. Spacer elements are positioned between two of the layers of the garment thus establishing and maintaining an in-between air gap. The invention disclosed in this prior art document aims to improve the heat resistance of a garment but it is not concerned with its weight and all the problems related thereto which have been mentioned above.

U.S. Pat. No. 4,814,222 discloses aramid fibers which are treated with a swelling agent to improve flame resistance. Such aramid fibers are used for the manufacture of garments which, due to the elevated specific weight of the fibers themselves, are heavy and rigid and, therefore, do not provide an adequate wear comfort.

WO 03/039280, which could be a prior right in Europe according to Articles 54(3) and 54(4) EPC, discloses a multilayer material which can be used as inner liner (thermal barrier) in protective clothing, particularly for fire fighters.

WO 03/0392280 is totally silent about the use of such multilayer materials as outer layer or single layer of protective clothing.

The problem at the root of the present invention is therefore to provide a heat, flame and electric arc resistant fabric which, if used as single or outer layer of protective garments, enables to increase wear comfort and to improve the dissipation of vapor and heat produced by the wearer.

BRIEF SUMMARY OF THE INVENTION

Now, it has been surprisingly found that the above mentioned problems can be overcome by a heat, flame, and electric arc resistant fabric for use as single or outer layer of protective garments, comprising at least two separate single plies each having a warp and a weft system, the at least two separate single plies being assembled together at predefined positions so as to build pockets, the warp and the weft systems of the at least two separate single plies being based on materials independently chosen from the group consisting of aramid fibers and filaments, polybenzimidazole fibers and filaments, polyamideimide fibers and filaments, poly (paraphenylene benzobisaxazole) fibers and filaments, phenol-formaldehyde fibers and filaments, melamine fibers and filaments, natural fibers and filaments, synthetic fibers and filaments, artificial fibers and filaments, glass fibers and filaments, carbon fibers and filaments, metal fibers and filaments, and composites thereof.

Due to its peculiar structure, the fabric according to the present invention can have a specific weight which is considerably lower than that of known fabrics having comparable mechanical and thermal properties.

Another aspect of the present invention is a garment for protection against heat, flames and electric arc comprising the above fabric as single or outer layer.

The garment according to the present invention strongly improves the wearer's comfort both during normal and critical situations. It is lighter and thinner than conventional garments having similar mechanical and thermal properties and it enables a higher heat and vapor dissipation from the wearer surface to the environment.

DETAILED DESCRIPTION OF THE INVENTION

Figure 1:
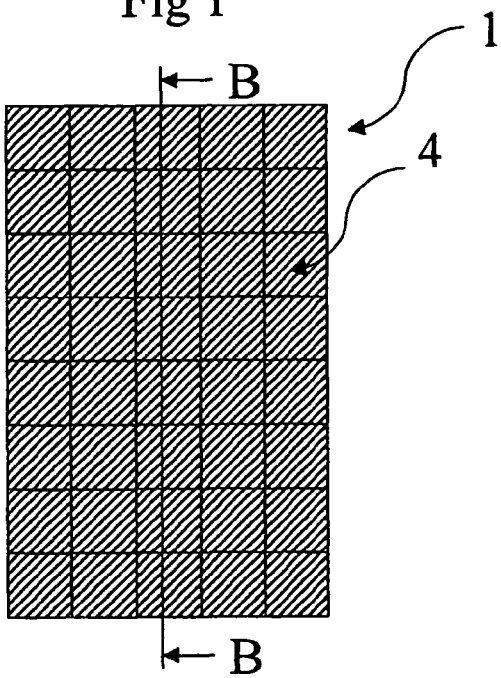
FIG. 1 is a top view of a preferred embodiment according to the present invention.
Figure 3A:
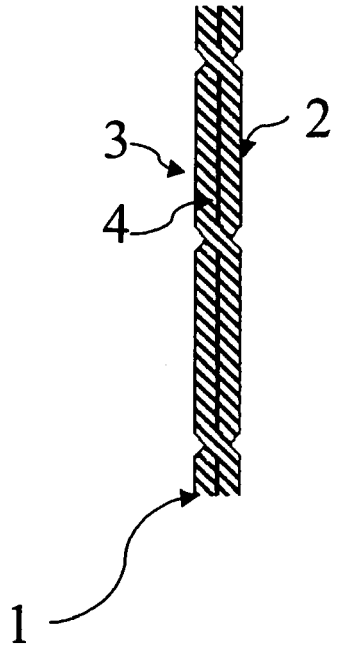
FIG. 3*a* is a cross sectional view of the fabric of FIG. 1 before undergoing thermal exposure. This cross sectional view is taken along the line B-B of FIG. 1.
Figure 3B:
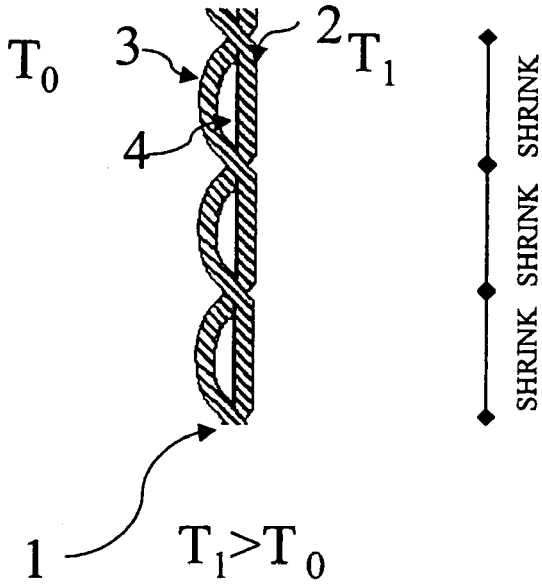
FIG. 3*b* is a cross sectional view of the fabric of FIG. 1 after undergoing thermal exposure ($T_1>T_0$). This cross sectional view is taken along the line B-B of FIG. 1.

Reference is made to FIGS. 1 and 3.

Under normal conditions, that is when on both sides of the fabric (1) the temperature equals room temperature $T_0$, the plies (2,3) of the fabric (1) are adjacent to each other so that the pockets (4) of the fabric (1) have a substantially flat structure.

In the case of thermal exposure, the ply (2) of the fabric (1), which is exposed to the elevated temperature $T_1$ (up to 300° C. or more) will shrink so that the fabric pockets will swell and form partially air filled chambers which will further isolate the wearer form the environment. An air insulation system is therefore automatically activated when needed during critical situations, thus improving the thermal performance of the fabric without increasing its specific weight.

Aramid fibers and filaments suitable for the manufacture of the fabric of the present invention can have various physical and chemical properties in accordance with the specific application of the fabric itself. Typically, the aramid fibers and filaments can be selected from the group consisting of poly-m-phenylenisophtalamid (meta-aramid), poly-p-phenylene-terephtalamid (para-aramid) and mixtures thereof. Commercially available meta-aramid and para-aramid fibers and filaments are available for example under the trade marks NOMEX® and KEVLAR®, respectively, from E.I. du Pont de Nemours and Company, Wilmington, Del., U.S.A.

Natural fibers and filaments which can be used in accordance with the present invention are for example wool, cotton and silk. Artificial fibers and filaments can be selected among viscose and chitosan, while synthetic fibers and filaments can be typically polyester, polyamid and polypropylene. Composites of one or more of such natural, artificial and synthetic fibers and filaments can be also used for the manufacture of the fabric of the present invention.

The selection of the different materials depends on the specific application of the fabric according to the present invention.

Typically, each single ply (2,3) of the fabric (1) of the present invention will include large amounts of fibers and filaments of materials having good thermal properties such as aramid, polybenzimidazole, polyamideimid, poly(paraphenylene benzobisaxazole), phenol-formaldehyde and melamine. However, for certain specific applications, it is appropriate to have one or more plies substantially made with materials like the natural, artificial and synthetic materials mentioned above. For protection against molten metal, for example, the fabric ply which will be directly in contact with the hot metal can advantageously include high amounts (up to 100 wt-%) of wool and viscose in order to create a gliding surface preventing the hot metal particles from sticking thereon.

According to a preferred embodiment of the present invention, the warp and weft systems of the at least two separate single plies are, independently to each other, based on monofilament yarns, multifilament yarns, spun yarns and core spun yarns. By "core spun yarn" is meant in the present invention a mono or multifilament core covered with a fiber covering. Advantageously, the warp and weft systems of the at least two separate single plies (2,3) are, independently to each other, single yarns, twisted yarns and hybrid yarns. By "hybrid yarns" is meant in the present invention twisted or covered yarns made of filament yarns, spun yarns, core spun yarns and composites thereof.

In a further preferred embodiment of the present invention, the warp and weft systems of the at least two separate single plies (2,3) comprise, independently to each other, single and twisted yarns comprising aramid fibers, aramid monofilaments, aramid multifilaments or composite fibers of aramid and polybenzimidazol.

Advantageously, the warp systems of the fabric of the present invention comprise, independently to each other, single and twisted yarns comprising aramid monofilaments or aramid multifilaments, and the weft systems comprise, independently to each other and in an alternate sequence, single or twisted yarns of aramid monofilaments or single or twisted yarns of aramid multifilaments. Still more advantageously, the weft systems of the fabric of the present invention comprise, independently to each other and in an alternate sequence, at least two different aramid multifilament single and twisted yarns.

For many applications, the fabric according to the present invention consists of two separate single plies which can be assembled together, for example, by weaving, knitting, sewing or gluing.

The fabric of the present invention typically comprises aramid fibers chosen from the group consisting of poly-m-phenyleniso-phtalamid, poly-p-phenylenterephtalamid and mixtures thereof. In order to further increase the mechanical properties of the fabric according to the present invention, and if the specific application requires it, the ply which will face the wearer (the internal ply in the garment) will be entirely made of poly-p-phenylenterephtalamid.

In accordance with the specific application, as it will be explained below, the two plies can be made of the same material or, alternatively, each ply can be made of a material having a different dimensional thermal shrinkage. By "dimensional thermal shrinkage" is meant the widthwise and lengthwise contraction of a fiber yarn or fabric on exposure to a heat source.

For applications where the time of exposure to a heat source is up to about 3 seconds, like in the case of electric arc, the two plies of the fabric can be made of the same material. In these situations, the side of the fabric exposed to the elevated temperature $T_1$ (FIG. 3*b*) will shrink relatively fast so that air filled pockets will be formed rapidly. Due to the short exposure, the temperature $T_0$ will not have the time to increase up to $T_1$ so that little shrinkage or no shrinkage at all will be observed at the fabric side facing the wearer. The insulating pockets will therefore maintain their volume during the entire period of exposure.

In order to further increase the insulation effect of the fabric for exposures up to 3 seconds, each separate single ply (2,3) can be made of a material having a different dimensional thermal shrinkage, the ply of the fabric which is exposed to the heat source having the higher dimensional thermal shrinkage. In this way, the difference in shrinkage between the two fabric plies will be still greater during thermal exposure so that still more voluminous air pockets will be formed.

Figure 2:
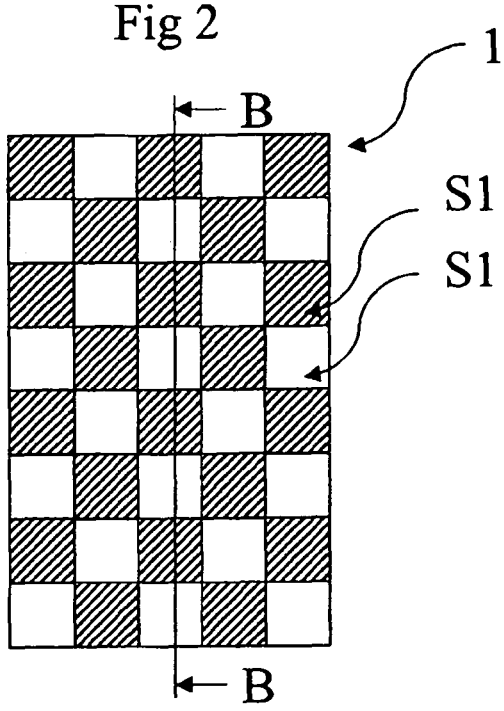
FIG. 2 is a top view of another preferred embodiment according to the present invention.
Figure 4A:
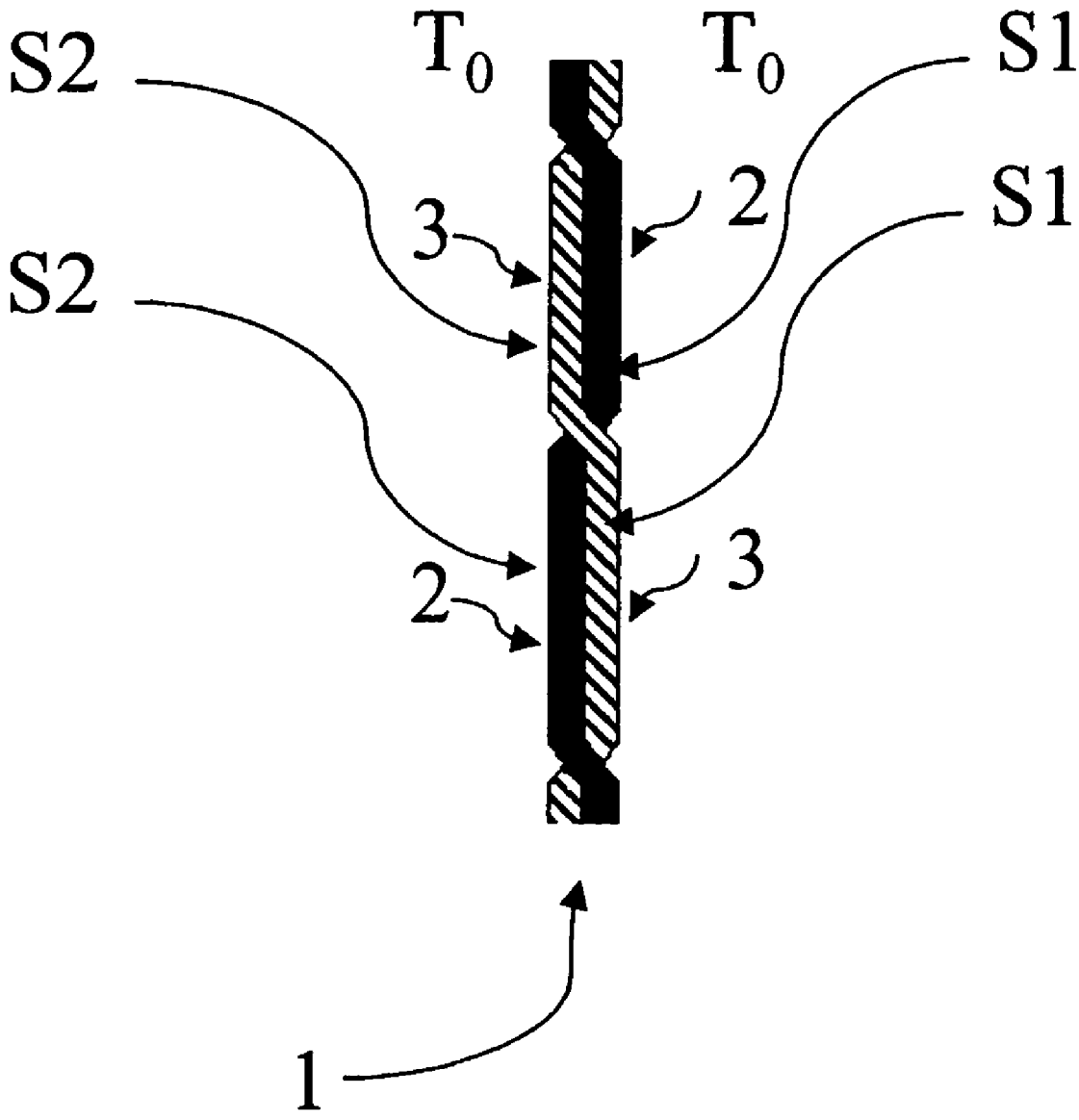
FIG. 4*a* is a cross sectional view of the fabric of FIG. 2 before undergoing thermal exposure. This cross sectional view is taken along the line B-B of FIG. 2.
Figure 4B:
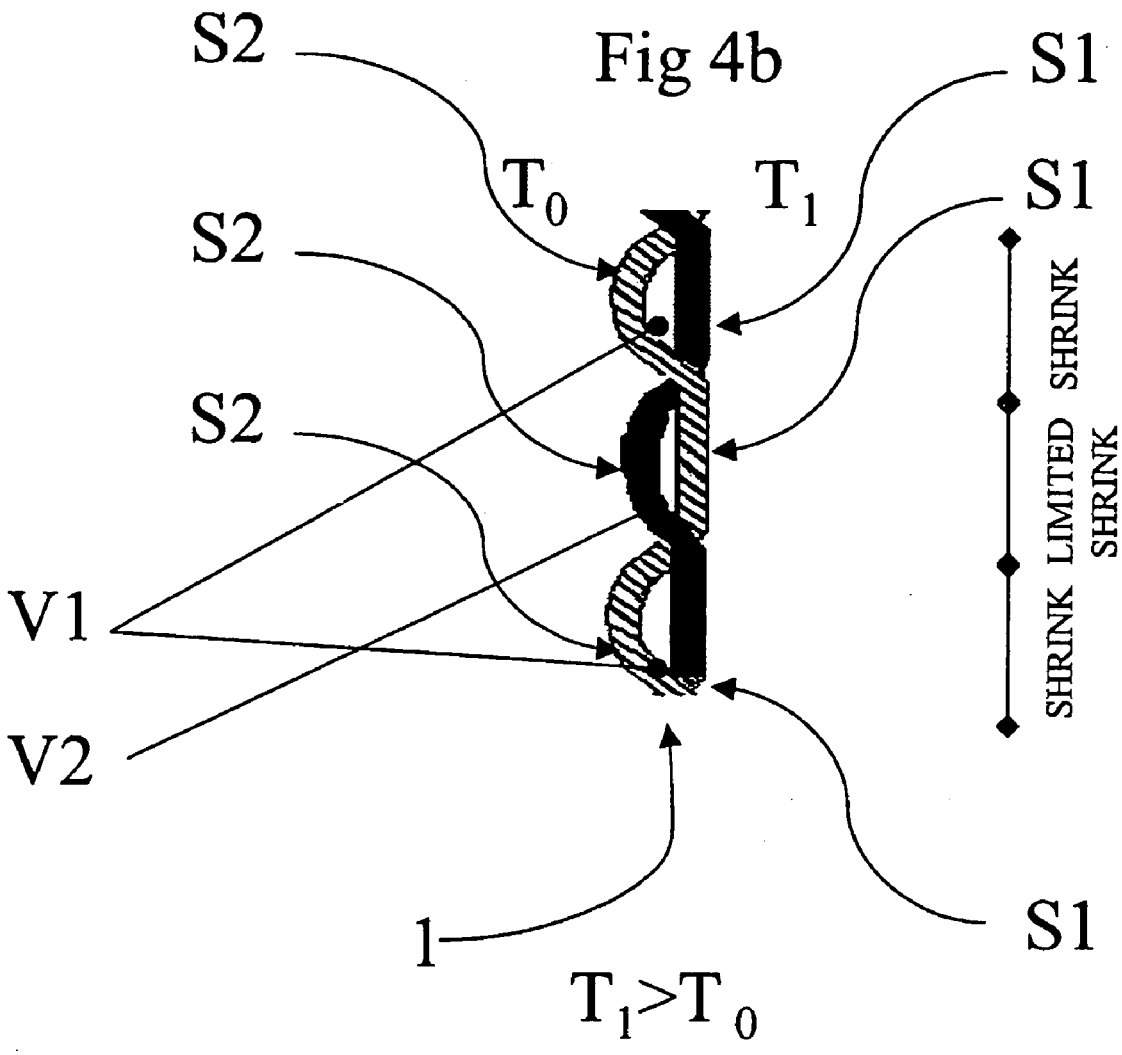
FIG. 4*b* is a cross sectional view of the fabric of FIG. 2 after undergoing thermal exposure ($T_1>T_0$) for a period of time up to 3 seconds. This cross sectional view is taken along the line B-B of FIG. 2.
Figure 4C:
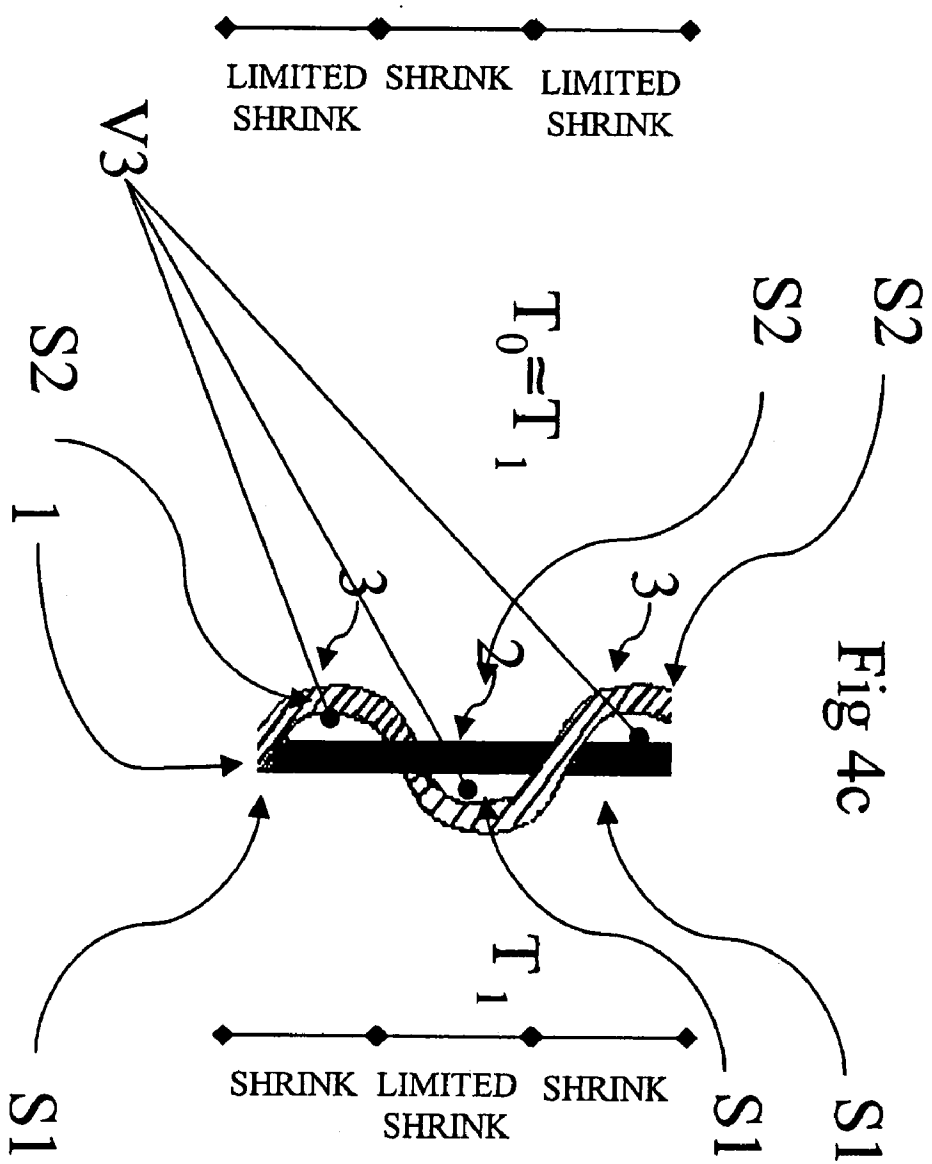
FIG. 4*c* is a cross sectional view of the fabric of FIG. 2 after undergoing thermal exposure ($T_0 \sim T_1$) for a period of time of more than 3 seconds. This cross sectional view is taken along the line B-B of FIG. 2.

FIGS. 2 and 4 depict a preferred embodiment for applications where the time of exposure to a heat source is more than 3 seconds. In such situations, for example, in the case of a fire, the fabric of the present invention is preferably made of two separate single plies (2,3) each made of a material having a different dimensional thermal shrinkage, the two separate single plies being woven together in such a way that they cross each other at the predefined positions so that the same side (FIGS. 2 and 4*a*, S1 or S2) of two adjacent pockets is alternately made of the two different separate single plies (2,3) according to a chess design. In the first phase of the thermal exposure (up to about 3 seconds, $T_0<T_1$, FIG. 4*b*), the side (S1) of the fabric exposed to the heat source will shrink relatively fast so that air filled pockets will be formed rapidly. Due to the difference in the dimensional thermal shrinkage of the plies (2,3) and because of the chess design of the fabric, the adjacent air filled pockets will alternately have two different volumes V1,V2, (V1>V2 FIG. 4*b*). In the second phase of the exposure (from 3 seconds up to 8 seconds or more, $T_0=T_1$, FIG. 4*c*), the side (S2) will also start to shrink. Due to the chess design of the fabric, and to the difference in the dimensional thermal shrinkage of the two plies (2,3), air filled pockets having a volume V3 (V3<V1,V2) will be formed on both sides of the fabric according to the shifted configuration depicted in FIG. 4*c*. Such air filled structure will be maintained during the rest of the time so that an air insulating system will be available during the whole thermal exposure.

Advantageously, the two separate single plies of the fabric according to the present invention are assembled together at predefined positions so as to build closed, adjacent pockets which are preferably square shaped. If compared to e.g. a tubular pockets structure, a square pockets structure provide superior strength and tear resistance in both the warp and weft direction and also provides superior abrasion resistance. Furthermore, such a structure provides more insulation effect because of the relatively small pockets that can respond to local heat inputs in a more efficient way. A square pockets structure confers optimal flexibility to the fabric of the invention and it provides superior visual aesthetics. Such fabric structure is also easier to be formed into a garment since the functionality of the square pockets is not affected by their orientation in the garment itself.

The optimal size of the pockets depends on the specific applications and on the materials used. Generally speaking, the larger the size of the pockets the larger the volume of the air filled pockets which are built during thermal exposure and, therefore, the better the insulation effect. This is, however, true up to a certain limit where the shrinkage of the materials no longer leads to the building of air filled insulation gaps and the fabric remains flat in despite of the thermal exposure. For this reason, each size of the pockets is typically between 5 and 50 mm and, preferably, between 8 and 32 mm.

The specific weight of the fabric according to the present invention is preferably between 100 g/m$^2$ and 900 g/m$^2$ and, still more preferably, between 170 and 320 g/m$^2$.

According to still another preferred embodiment of the present invention, the fabric (1) includes filling yarns which are positioned between the at least two separate single plies (2,3) of the fabric. The filling yarns can be of materials having good thermal properties as those mentioned above, and they aim to increase the thickness of the fabric (1) thus creating further insulating volume during critical conditions such as heat and flames.

A second aspect of the present invention is a garment for protection against heat, flames and electric arc comprising a structure made of at least one layer of the fabric described above.

According to a preferred embodiment of the present invention the garment comprises a structure comprising an internal layer, optionally an intermediate layer made of a breathing waterproof material, and an outer layer made of the above-described fabric of the invention.

According to another preferred embodiment, the fabric of the present invention used for manufacturing the protective garment is made of two separate single plies (2,3), the former being positioned internally and the latter externally in the structure of the garment, the dimensional thermal shrinkage of the internally positioned separate single ply being the same (for example, the same material for both plies) or lower than that of the externally positioned separate single ply. This embodiment is particularly suitable for applications where the garment wearer is exposed to a heat source for periods of time up to 3 seconds, like for example in the case of electric arc.

For expositions to a heat source longer than 3 seconds, a fabric having a chess design, as shown in FIG. 2, can be more appropriate for the reasons mentioned above.

Preferably, the fabric is made of two separate single plies comprising poly-p-phenyleneterephtalamid, the internally positioned ply comprising at least the same amount of poly-p-phenyleneterephtalamid as the externally positioned ply. For some applications, in order to confer to the garment elevated mechanical properties, the internally positioned ply is entirely made of poly-p-phenylenterephtalarmid.

The internal layer, which faces the body of the wearer, can be an insulating lining made for example of a fabric of two, three or more plies. The purpose of such lining is to have an additional insulating layer further protecting the wearer from the heat.

The internal layer can be made of a woven, a knitted or a non-woven fabric. Preferably, the internal layer is made of a fabric comprising non meltable fire resistant materials, such as a fleece or a woven fabric of meta-aramid.

The garment according to the present invention can be manufactured in any possible way. It can include an additional, most internal layer made, for example, of cotton or other materials further improving the wearing comfort. The most internal layer directly faces the wearer's skin or the wearer's underwear.

The garment according to the present invention can be of any kind including, but not limited to jackets, coats, trousers, gloves, overalls and wraps.

EXAMPLES

The invention will be further described in the following examples.

Example 1

A blend of fibers, commercially available from E.I. du Pont de Nemours and Company, Wilmington, Del., U.S.A., under the trade name Nomex® N307, having a cut length of 5 cm and consisting of:

93 wt % of pigmented poly-metaphenylene isophthalamide (meta-aramid), 1.4 dtex staple fibers;

5 wt % of poly-paraphenylene terephthalamide (para-aramid) fibers; and 2 wt % of carbon core polyamide sheath antistatic fibers was ring spun into two types of single staple yarns (Y1 and Y2) using a conventional cotton staple processing equipment.

Y1 had a linear density of Nm 60/1 or 167 dtex and a twist of 850 Turns Per Meter (TPM) in Z direction and it was subsequently treated with steam to stabilize its tendency to wrinkle. Y1 was used as weft yarn.

Y2 had a linear density of Nm 70/1 or 143 dtex and a twist of 920 TPM in Z direction. Y2 was subsequently treated with steam to stabilize his tendency to wrinkle. Two Y2 yarns were then plied and twisted together. The resulting plied and twisted yarn (TY2) had a linear density of Nm 70/2 or 286 dtex and a twist of 650 TPM in S direction. TY2 was used as warp yarn.

Figure 5:
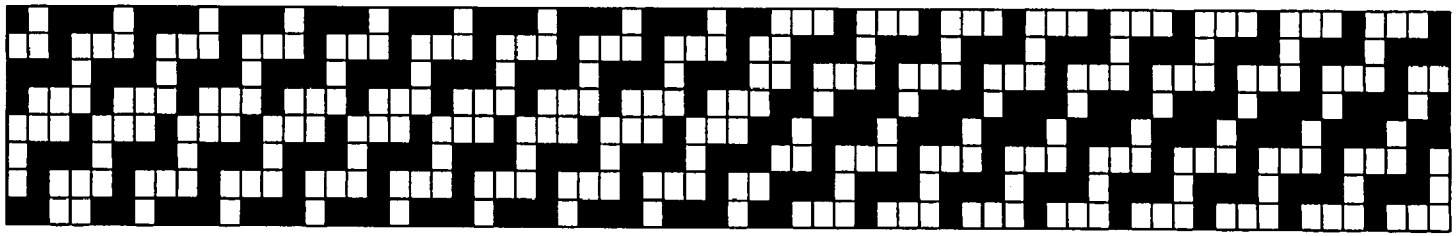
FIG. 5 is a schematic representation of the weave construction of the fabrics of Examples 1, 2, 4, 5 and 6.

Y1 and TY2 were woven into a two plies weave fabric having closed square pockets with size 8 mm. The fabric was woven according to the construction depicted in FIG. 5. The weave fabric had 42 ends/cm (warp) (21 ends/cm for each ply), 48 weft/cm (weft) (24 ends/cm for each ply) and a specific weight of 200 g/m$^2$. The following physical tests were carried out on the thus obtained fabric:

Determination of the breaking strength and elongation according to ISO 5081;

Determination of the tear resistance according to ISO 4674;

Determination of the dimensional change after washing and drying according to ISO 5077;

Combined radiant and convective heat testing according to the TPP method (NFPA 1971:2000, section 6-10, ISO 17492) as a single layer with a heat flux calibrated to 2.0 cal/cm$^2$/s, TPP rating being the energy (cal/cm$^2$) measured to simulate a second-degree burn on the skin of an individual;

Electric arc testing according to ASTM F 1959/F 1959M-99.

The fabric was tested both as single layer (Fabric in Table I) and as the outershell of a multilayer structure (Garment in Table I) which further comprised 1) an intermediate layer of a PTFE membrane laminate on a non-woven fabric made of 85 wt -% Nomex® and 15 wt -% Kevlar® and having a specific weight of 135 g/m$^2$ (commercially available under the trade name GORE-TEX® Fireblocker N from the company W. L. Gore and Associates, Delaware, U.S.A.), and 2) an internal layer of a meta-aramid thermal barrier having a specific weight of 140 g/m$^2$ quilted on a 100 wt -% Nomex® N 307 fabric having a specific weight of 110 g/m$^2$.

The results are given in Table I. The fabric pockets swelled while undergoing the combined radiant and convective heat testing and the electric arc testing.

TABLE 1

| | Warp | Weft |
|---|---|---|
| Breaking strength (N) | 1390 | 860 |
| Elongation (%) | 38.6 | 36.4 |
| Tear resistance (N) | 72.8 | 95.5 |
| Dimensional change after washing (%) | −1.0 | −2.0 |
| Specific Weight (g/m$^2$) | 200 | |
| TPP (Fabric) | | |
| Time to record pain (s) | 4.7 | |
| Second degree burn (s) | 7.3 | |
| TPP rating (cal/cm$^2$) | 14.6 | |
| Fabric Failure Factor ($10^{-2}$ cal/g) | 7.3 | |
| TPP (Garment) | | |
| Time to record pain (s) | 15.1 | |
| Second degree burn (s) | 20.7 | |
| TPP rating (cal/cm$^2$) | 41.5 | |
| Fabric Failure Factor ($10^2$ cal/g) | 7.1 | |

Table 1 shows an excellent performance of the fabric, in particular with regard to the Fabric Failure Factor (FFF), which is defined as follows: FFF=TPP (cal/cm$^2$)/fabric specific weight (g/m$^2$).

The fabric tested as single layer had an FFF value of 7.3×10$^2$ cal/g while a similar fabric of the same specific weight and the same materials, but woven according to a standard twill construction, had an FFF value of less than 6.6×10$^2$ cal/g. This value is considered by the persons skilled in the art to be a sort of technical barrier which conventional single layer fabrics available on the market and having similar weights and made of similar materials have never been able to pass.

The fabric tested as outershell of a multilayer structure had an FFF value of 7.1×10$^2$ cal/g, while comparable conventional multilayer structures had FFF values ranging between 5.2×10$^2$ and 6.7×10$^2$ cal/g.

The electric arc test according to ASTM F1959 generated an ATPV value of about 9.5 cal/cm$^2$ and an estimated energy to break-open (EBT) measured over a T-shirt of about 12 cal/cm$^2$.

Similar fabrics of the same weight and the same materials but woven according to a standard 2/1 twill construction have significantly lower ATPV value, ranging between 4.2 cal/cm$^2$ and 5.2 cal/cm$^2$ and similar EBT measured over a T-shirt ranging between 10 cal/cm$^2$ and 15 cal/cm$^2$. To achieve an ATPV value of 9.5 cal/cm$^2$, the specific weight of a fabric woven according to a standard 2/1 twill construction must be at least 365 g/m$^2$.

This test confirms that the fabric of the invention confers good protection against electric arc despite its relatively low specific weight.

Example 2

Two plies weave fabrics with squared pockets of different sizes were prepared according to Example 1.

For the first ply, Y1 was used as weft and TY2 as warp.

For the second ply, the weft and warp were prepared as follows:

A blend of fibers, commercially available from E. I du Pont de Nemours and Company, Wilmington, Del., U.S.A., under the trade name Nomex® N305 having a cut length of 5 cm and consisting of:

75% pigmented poly-metaphenylene isophthalamide (meta-aramid) 1.7 dtex staple fibers;

23% poly-paraphenylene terephthalamide (para-aramid) fibers; and

2% of carbon core poyamide sheath antistatic fibers was ring spun into two types of single staple yarns (Y3 and Y4) using a conventional cotton staple processing equipment.

Y3 had a linear density of Nm 60/1 or 167 dtex and a twist of 930 TPM in Z direction, and it was subsequently treated with steam to stabilize its tendency to wrinkle. Y3 was used as weft yarn.

Y4 had a linear density of Nm 70/1 or 143 dtex and a twist of 1005 TPM in Z direction, and it was subsequently treated with steam to stabilize its tendency to wrinkle.

Two Y4 yarns were then plied and twisted together. The resulting plied yarn (TY4) had a linear density of Nm 70/2 or 286 dtex and a twist of 0.700 TPM in S direction. TY4 was used as warp yarn.

Three weave fabrics having closed square pockets of 8×8, 16×16 and 32×32 mm, respectively were prepared. The three fabrics had 42 ends/cm (warp) (21 ends/cm for each ply), 48 weft/cm (weft) (24 ends/cm for each ply) and a specific weight of 200 g/m$^2$. The same physical tests as in Example 1 were carried out on the three fabrics with exception of the electric arc testing according to ASTM F1959.

The fabrics were tested both as single layer (Fabric in Table 2) and as the outershell of the multilayer structure as in Example 1 (Garment in Table 2).

The results are given in Table 2. The pockets of the fabric swelled while undergoing the combined radiant and convective heat testing.

TABLE 2

| | Pocket size | | | | | |
|---|---|---|---|---|---|---|
| | 8 × 8 mm | | 16 × 16 mm | | 32 × 32 mm | |
| | warp | Weft | warp | weft | warp | weft |
| Breaking strength (N) | 1105 | 750 | 1075 | 700 | 1065 | 710 |
| Elongation (%) | 10.7 | 12.1 | 10.4 | 11.1 | 9.7 | 11.4 |
| Tear resistance (N) | 81.0 | 97.0 | 78.7 | 113.2 | 80.2 | 115.8 |
| Dimensional change after washing (%) | −0.5 | −4.0 | −0.0 | −4.0 | −0.0 | −3.5 |
| Specific Weight (g/m$^2$) | 205 | | 204 | | 204 | |
| TPP (Fabric) | | | | | | |
| Time to record pain (s) | 4.5 | | 4.6 | | 4.9 | |
| Second degree burn (s) | 6.8 | | 6.9 | | 7.2 | |
| TPP rating (cal/cm$^2$) | 13.5 | | 13.7 | | 14.5 | |
| Fabric Failure Factor ($10^2$ cal/g) | 6.7 | | 6.9 | | 7.2 | |
| TPP (Garment) | | | | | | |
| Time to record pain (s) | 14.4 | | 14.8 | | 15.4 | |
| Second degree burn (s) | 20.5 | | 20.7 | | 21.4 | |
| TPP rating (cal/cm$^2$) | 40.9 | | 41.3 | | 42.8 | |
| Fabric Failure Factor ($10^2$ cal/g) | 7.0 | | 7.1 | | 7.3 | |

Table 2 shows an excellent performance of the fabric, in particular with regard to the FFF values which were between $6.7\times10^2$ and $7.2\times10^2$ cal/g. A similar fabric of the same specific weight and the same materials but woven according to a standard 2/1 twill construction had an FFF value of $6.6\times10^2$ cal/g.

The fabrics tested as outershell of a multilayer structure had FFF values between $7.0\times10^2$ and $7.3\times10^2$ cal/g, while comparable conventional multilayer structures had FFF values ranging between $5.2\times10^2$ and $6.7\times10^8$cal/g.

Table 2 also shows that the larger the size of the pockets, the better is the performance of the fabric with regard to the TPP test.

Example 3

Figure 6:
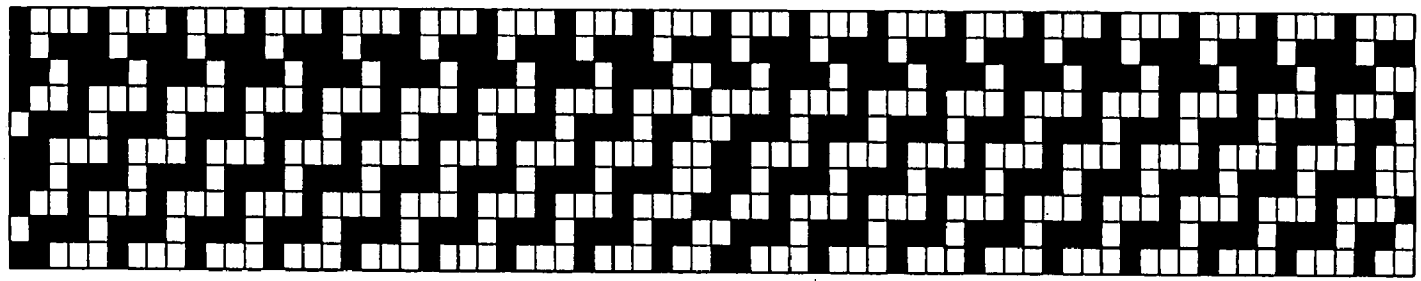
FIG. 6 is a schematic representation of the weave construction of the fabric of Example 3.

Two plies weave fabrics with squared pockets of different sizes were prepared using the same materials as in Example 2. The two plies were woven together by alternating them so as to obtain a chess design, as shown in FIG. 2, where the same side of two adjacent pockets is alternately made of the two different separate single plies. The fabric was woven according to the construction depicted in FIG. 6.

Three weave fabrics having closed square pockets of 8×8, 16×16 and 32×32 mm, respectively were prepared. The three fabrics had 42 ends/cm (warp) (21 ends/cm for each ply), 48 weft/cm (weft) (24 ends/cm for each ply) and a specific weight of 200 g/m$^2$. The same physical tests as in Example 1 were carried out on the three fabrics with exception of the electric arc testing according to ASTM F1959.

The fabrics were tested both as single layer (Fabric in Table 3) and as the outershell of the multilayer structure as in Example 1 (Garment in Table 3).

The results are given in Table 3. The pockets of the fabric swelled while undergoing the combined radiant and convective heat testing.

TABLE 3

| | Pocket size | | | | | |
|---|---|---|---|---|---|---|
| | 8 × 8 mm | | 16 × 16 mm | | 32 × 32 mm | |
| | Warp | Weft | Warp | Weft | Warp | Weft |
| Breaking strength (N) | 1090 | 720 | 1075 | 700 | 1070 | 690 |
| Elongation (%) | 10.8 | 12.1 | 10.3 | 11.5 | 9.6 | 11.0 |
| Tear resistance (N) | 89.6 | 112.3 | 107.8 | 75.4 | 110.1 | 78.5 |
| Dimensional change after washing (%) | −1.0 | −4.5 | −0.5 | −4.5 | −0.0 | −4.5 |
| Specific Weight (g/m$^2$) | 205 | | 203 | | 200 | |
| TPP (Fabric) | | | | | | |
| Time to record pain (s) | 4.6 | | 4.7 | | 4.9 | |
| Second degree burn (s) | 6.9 | | 7.1 | | 7.3 | |
| TPP rating (cal/cm$^2$) | 13.8 | | 14.2 | | 14.6 | |
| Fabric Failure Factor ($10^2$ cal/g) | 6.9 | | 7.1 | | 7.3 | |
| TPP (Garment) | | | | | | |
| Time to record pain (s) | 14.2 | | 14.8 | | 15.3 | |
| Second degree burn (s) | 20.3 | | 20.8 | | 21.6 | |
| TPP rating (cal/cm$^2$) | 40.7 | | 41.6 | | 43.3 | |
| Fabric Failure Factor ($10^2$ cal/g) | 7.0 | | 7.1 | | 7.4 | |

Table 3 shows an excellent performance of the fabric. The chess design generally confers to the fabrics improved thermal and mechanical properties in case of longer exposure to heat and flames.

In analogy with Example 2, Table 3 also shows that the larger the size of the pockets, the better is the performance of the fabric with regard to the TPP test.

Example 4

Two plies weave fabrics with squared pockets were prepared according to Example 1.

For the first ply, Y1 was used as weft and TY2 as warp.

For the second ply, the weft and warp were prepared as follows: 100% Kevlar® stretch broken fibers were ring spun into two types of single staple yarns (Y5 and Y6) using a conventional worsted staple processing equipment.

Y5 had a linear density of Nm 60/1 or 167 dtex and a twist of 575 TPM in Z direction, and it was subsequently treated with steam to stabilize its tendency to wrinkle. Y5 was used as weft yarn.

Y6 had a linear density of Nm 70/1 or 143 dtex and a twist of 620 TPM in Z direction, and it was subsequently treated with steam to stabilize its tendency to wrinkle.

Two Y6 yarns were then plied and twisted together. The resulting plied yarn (TY6) had a linear density of Nm 70/2 or 286 dtex and a twist of 600 TPM in S direction. TY6 was used as warp yarn.

A fabric weave having closed square pockets of 8×8 was prepared. This fabric had 42 ends/cm (warp) (21 ends/cm for each ply), 48 weft/cm (weft) (24 ends/cm for each ply) and a specific weight of 200 g/m$^2$. The same physical tests as in Example 1 were carried out on this fabric with exception of the electric arc testing according to ASTM F1959.

The fabric was tested both as single layer (Fabric in Table 4a) and as the outershell of the multilayer structure as in Example 1 (Garment in Table 4a).

The results are given in Table 4a. The pockets of the fabric swelled while undergoing the combined radiant and convective heat testing.

TABLE 4a

| | warp | weft |
|---|---|---|
| Breaking strength (N) | 3045 | 2080 |
| Elongation (%) | 10.5 | 8.7 |
| Tear resistance (N) | 208 | 294 |
| Dimensional change after washing (%) | −1.5 | −2.5 |
| Specific Weight (g/m$^2$) | 208 | |
| TPP (Fabric) | | |
| Time to record pain (s) | 4.6 | |
| Second degree burn (s) | 7.0 | |
| TPP rating (cal/cm$^2$) | 14.1 | |
| Fabric Failure Factor (10$^2$ cal/g) | 7.0 | |
| TPP (Garment) | | |
| Time to record pain (s) | 16.7 | |
| Second degree burn (s) | 23.4 | |
| TPP rating (cal/cm$^2$) | 46.9 | |
| Fabric Failure Factor (10$^2$ cal/g) | 8.0 | |

Table 4a shows an excellent performance of the fabric in particular as an outershell in a multilayered construction with the highest FFF value at 8.0×10$^2$ cal/g. The physical performance of the fabric with regard to breaking strength and tear resistance is also excellent. A fabric with the same components and specific weight, but woven according to a standard monolayer construction, would show approximately half of this performance.

The fabric was tested as single layer in accordance with the TATE (Tensile After Thermal Exposure) method:

The TATE method is based on the determination of breaking strength and elongation (Strip method) according to the standard ISO 5081 after TPP exposures of 2 s and 4 s with a heat flux calibrated to 2.0 cal/cm$^2$/sec.

The test conditions were:

| | |
|---|---|
| Testing machine: | constant rate of traverse (CRT) with a load cell of 2000 N |
| Gauge length: | 200 ± 1 mm |
| Sample width: | 50 ± 0.5 mm |
| Speed of traverse: | 100 mm/min. |

The results are summarized in Table 4b.

TABLE 4b

| | | 0 s | 2 s | 4 s |
|---|---|---|---|---|
| Breaking strength | N | 2780 | 2395 | 895 |
| Elongation at break | % | 9.4 | 10.1 | 7.3 |

Conventional fabrics currently used in Europe as outershell of firefighter turn out coats have a weight-normalized TATE value after 4 seconds (the TATE value divided by the fabric specific weight) ranging between 1.8 N g$^{-1}$cm$^2$ and 3.3 N g$^{-1}$cm$^2$, while the fabric of this Example has a value of about 4.5 N g$^{-1}$cm$^2$. This clearly shows that this fabric is particularly suitable as outershell of protective garments for fire fighters.

Example 5

Two plies weave fabrics with squared pockets were prepared according to Example 1.

For the first ply, the weft and warp were prepared as follows: A blend of 50% Kevlar® and 50% Nomex® long staple fibers were ring spun into two types of single staple yarns (Y7 and Y8) using a conventional worsted staple processing equipment.

Y7 had a linear density of Nm 60/1 or 167 dtex and a twist of 575 TPM in Z direction, and it was subsequently treated with steam to stabilize its tendency to wrinkle. Y7 was used as weft yarn.

Y8 had a linear density of Nm 70/1 or 143 dtex and a twist of 620 TPM in Z direction, and it was subsequently treated with steam to stabilize its tendency to wrinkle.

Two Y8 yarns were then plied and twisted together. The resulting plied yarn (TY8) had a linear density of Nm 70/2 or 286 dtex and a twist of 600 TPM in S direction. TY8 was used as warp yarn.

For the second ply, Y5 was used as weft and TY6 as warp.

A fabric weave having closed square pockets of 8×8 was prepared. This fabric had 42 ends/cm (warp) (21 ends/cm for each ply), 48 weft/cm (weft) (24 ends/cm for each ply), and a specific weight of 200 g/m$^2$. The same physical tests as in Example 1 were carried out on this fabric. The fabric was tested both as single layer (Fabric in Table 5a) and as the outershell of the multilayer structure as in Example 1 (Garment in Table 5a).

The results are given in Table 5a. The pockets of the fabric swelled while undergoing the combined radiant and convective heat testing and the electric arc testing.

TABLE 5a

| | warp | weft |
|---|---|---|
| Breaking strength (N) | 3575 | 2940 |
| Elongation (%) | 10.9 | 6.4 |
| Tear resistance (N) | 249 | 343 |
| Dimensional change after washing (%) | −1.5 | −1.5 |
| Specific Weight (g/m$^2$) | 210 | |
| TPP Single layer | | |
| Time to record pain (s) | 4.3 | |
| Second degree burn (s) | 6.7 | |
| TPP rating (cal/cm$^2$) | 13.5 | |
| Fabric Failure Factor (10$^2$ cal/g) | 6.7 | |
| TPP Garment | | |
| Time to record pain (s) | 15.5 | |
| Second degree burn (s) | 21.4 | |
| TPP rating (cal/cm$^2$) | 42.9 | |
| Fabric Failure Factor (10$^2$ cal/g) | 7.3 | |

Table 5a shows an excellent thermal performance of the fabric in particular as an outershell in a multilayer construction with an FFF of 7.3×10$^2$ cal/g. Fabric physical properties like breaking strength and tear resistance are also excellent.

The electric arc test according to ASTM F1959 generated an EBT measured over a T-shirt of about 22 cal/cm$^2$, thus confirming that this fabric is excellent for protection against electric arc.

Similar fabrics of the same specific weight and the same materials but woven according to a standard 2/1 twill construction have significant lower EBT values, ranging between 10 cal/cm$^2$ and 15 cal/cm$^2$.

The fabric was tested as single layer in accordance with the TATE method as described in Example 4.

The results are summarized in Table 5b.

TABLE 5b

| | | 0 s | 2 s | 4 s |
|---|---|---|---|---|
| Breaking strength | N | 3600 | 3360 | 890 |
| Elongation at break | % | 10.7 | 10.3 | 7.4 |

Conventional fabrics currently used in Europe as outershell of firefighter turn out coats have a weight-normalized TATE value after 4 seconds (the TATE value divided by the fabric specific weight) ranging between 1.8 N $g^{-1}cm^2$ and 3.3 N $g^{-1}cm^2$, while the fabric of this Example has a value of about 4.5 N $g^{-1}cm^2$. This clearly shows that this fabric is particularly suitable as outershell of protective garments for fire fighters.

Example 6

A two plies weave fabric with squared pockets was prepared according to Example 1.

A Nomex® T 430 filament yarn of 220 dtex (Y9) was used as weft and warp for the first ply.

The weft and warp of the second ply were prepared as follows.

A blend of fibers, commercially available from E.I. du Pont de Nemours and Company, Wilmington, Del., U.S.A., under the trade name Nomex® E502, having a cut length of 5 cm and consisting of:

93 wt % of semi-crystallized ecru poly-metaphenylene isophthalamide (meta-aramid), 1.4 dtex staple fibers;

5 wt % of poly-paraphenylene terephthalamide (para-aramid) fibers; and 2 wt -% of carbon core polyamide sheath antistatic fibers was ring spun into two types of single staple yarns (Y10 and Y11) using a conventional cotton staple processing equipment.

Y10 had a linear density of Nm 60/1 or 167 dtex and a twist of 850 Turns Per Meter (TPM) in Z direction, and it was subsequently treated with steam to stabilize its tendency to wrinkle. Y10 was used as weft yarn.

Y11 had a linear density of Nm 70/1 or 143 dtex and a twist of 920 TPM in Z direction. Y11 was subsequently treated with steam to stabilize his tendency to wrinkle. Two Y11 yarns were then plied and twisted together. The resulting plied and twisted yarn (TY11) had a linear density of Nm 70/2 or 286 dtex, and a twist of 650 TPM in S direction. TY11 was used as warp yarn.

Y10 and TY11 were woven into a two plies weave fabric having closed square pockets with size 32 mm. The weave fabric had 42 ends/cm (warp) (21 ends/cm for each ply), 48 weft/cm (weft) (24 ends/cm for each ply) and a specific weight of 210 g/$m^2$. The same physical tests as in Example 1 were carried out on the fabric with exception of the electric arc testing according to ASTM F1959.

The results are given in Table 6. The fabric pockets swelled while undergoing the combined radiant and convective heat testing.

TABLE 6

| | Warp | weft |
|---|---|---|
| Breaking strength (N) | 1350 | 1170 |
| Elongation (%) | 31.5 | 27.4 |
| Tear resistance (N) | 120.2 | 118.2 |

TABLE 6-continued

| | Warp | weft |
|---|---|---|
| Dimensional change After washing (%) | −1.0 | −3.0 |
| Specific Weight (g/$m^2$) | 210 | |
| TPP Single layer | | |
| Time to record pain (s) | 4.4 | |
| Second degree burn (s) | 7.4 | |
| TPP rating (cal/$cm^2$) | 14.9 | |
| Fabric Failure Factor ($10^2$ cal/g) | 7.1 | |
| TPP Garment | | |
| Time to record pain (s) | 16.3 | |
| Second degree burn (s) | 22.9 | |
| TPP rating (cal/$cm^2$) | 45.7 | |
| Fabric Failure Factor ($10^2$ cal/g) | 7.7 | |

Table 6 shows an excellent thermal performance of the fabric, both as single layer and as outershell in a multilayer structure. The physical properties of the fabric such as the breaking strength and the tear resistance are also excellent. This fabric is particularly suitable for the manufacture of racing suits due to its visual aesthetic (silky appearance) and its excellent protection versus lightness ratio.

The same performance is currently achieved with conventional single layer fabrics having a total specific weight of more than 400 g/$m^2$.

The invention claimed is:

1. Heat, flame, and electric arc resistant fabric (1) for use as single or outer layer of protective garments, characterized in that it comprises at least two different warp yarns and at least two different weft yarns woven together at predefined positions so as to build closed, adjacent, and square shaped pockets having upper and lower fabric surfaces having different dimensional thermal shrinkages;

the warp and weft yarns consisting of monofilament yarns, multifilament yarns, spun yarns or core spun yarns based on materials independently chosen from the group consisting of aramid fibers and filaments, polybenzimidazole fibers and filaments, polyamide-imide fibers and filaments, poly(paraphenylene benzobisoxazole) fibers and filaments, phenol-formaldehyde fibers and filaments, melamine fibers and filaments, natural fibers and filaments, glass fibers and filaments, carbon fibers and filaments, metal fibers and filaments, and composites thereof; and wherein the at least two different warp yarns and the at least two different weft yarns are woven together by alternating them so as to obtain a chess board design such that two adjacent pockets have different upper or lower fabric surfaces.

2. The fabric (1) according to claim 1 wherein the warp and weft yams are, independently chosen from the group consisting of single yarns, twisted yams and hybrid yarns.

3. The fabric (1) according to claim 1, wherein the pocket size is between 5 and 50 mm.

4. The fabric (1) according to claim 3, wherein the pocket size is between 8and 32 mm.

5. The fabric (1) according to claim 1, having a specific weight between 100 g/$m^2$ and 900 g/$m^2$.

6. The fabric (1) according to claim 5, having a specific weight between 170 and 320 g/$m^2$.

7. Garment for protection against heat, flames and electric arc comprising a structure made of at least one layer of a fabric (1) according to claim 1.

8. The garment according to claim 7, comprising an internal layer.

9. The fabric according to claim 1, comprising at least two different aramid yarns.

* * * * *